US007641318B2

(12) United States Patent
Mataki

(10) Patent No.: US 7,641,318 B2
(45) Date of Patent: Jan. 5, 2010

(54) IMAGE FORMING METHOD

(75) Inventor: Hiroshi Mataki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 499 days.

(21) Appl. No.: 11/453,014

(22) Filed: Jun. 15, 2006

(65) Prior Publication Data

US 2006/0284912 A1 Dec. 21, 2006

(30) Foreign Application Priority Data

Jun. 17, 2005 (JP) ..... 2005-177935

(51) Int. Cl.
*B41J 2/045* (2006.01)

(52) U.S. Cl. ..... 347/68; 347/54

(58) Field of Classification Search ..... 347/68
See application file for complete search history.

(56) References Cited

U.S. PATENT DOCUMENTS 6,457,818 B1 * 10/2002 Kurashima et al. ..... 347/71
6,752,493 B2 * 6/2004 Dowell et al. ..... 347/89
7,497,557 B2 * 3/2009 Sugahara ..... 347/68
2002/0175976 A1 * 11/2002 Okuda ..... 347/71

FOREIGN PATENT DOCUMENTS

JP 4-45947 A 2/1992

* cited by examiner

*Primary Examiner*—Matthew Luu
*Assistant Examiner*—Brian J Goldberg
(74) *Attorney, Agent, or Firm*—Birch, Stewart, Kolasch & Birch, LLP

(57) ABSTRACT

The image forming apparatus comprises: a plurality of ejection ports through which liquid is ejected toward a prescribed recording medium; a plurality of pressure chambers which are respectively connected to the plurality of ejection ports; a plurality of first actuators which respectively change volume of the plurality of pressure chambers; a common liquid chamber which is connected to the plurality of pressure chambers; a second actuator which changes volume of the common liquid chamber; and a drive unit which supplies drive signals to the first actuators and the second actuator, such that the first actuators cause the volume of the pressure chambers to contract to eject the liquid through the ejection ports and subsequently to expand the volume of the pressure chambers, and causes the second actuator to contract the volume of the common liquid chamber after the volume of the pressure chambers has been expanded.

3 Claims, 8 Drawing Sheets

IMAGE FORMING METHOD

BACKGROUND OF THE INVENTION

1. Field of the Invention

The present invention relates to an image forming apparatus, and more particularly to an image forming apparatus in which an image is formed on a recording medium by ejecting liquid from ejection ports toward a recording medium such as paper by changing the volume of pressure chambers connected to the ejection ports.

2. Description of the Related Art

There is known an image forming apparatus in the related art, which forms an image on a recording medium, such as paper, by ejecting ink from a plurality of nozzles toward the recording medium, while moving a liquid ejection head having an arrangement of the nozzles and the recording medium, relatively with respect to each other.

A known liquid ejection head mounted in the image forming apparatus is, for example, a piezo-type liquid ejection head, in which ink is supplied to pressure chambers connected to nozzles, and the volume of the pressure chambers is changed, thereby causing the ink inside the pressure chambers to be ejected from the nozzles, by applying a drive signal corresponding to the image data to piezoelectric elements that are installed through a diaphragm plate on the outer side of the pressure chambers.

In the image forming apparatus having the inkjet head, in order to be able to form an image at high speed by shortening the ink ejection cycle, it is necessary to improve the refill speed of the liquid into the pressure chambers.

Japanese Patent Application Publication No. 4-45947 (and in particular, FIGS. 1, 2 and 3) discloses that the inkjet head is provided with drive elements (individual drive piezoelectric elements) for changing the volume of the pressure chambers, and another drive element (common liquid chamber driving piezoelectric element) for changing the volume of the common liquid chamber which supplies liquid to the pressure chambers, in such a manner that a pulse waveform is applied to the common liquid chamber driving piezoelectric element immediately after the meniscus cut-off time.

However, there is difficulty in refilling ink without causing disturbance to ink ejection.

More specifically, if a pulse waveform is applied to the common liquid chamber driving piezoelectric element immediately after the meniscus cut-off time, as in Japanese Patent Application Publication No. 4-45947, then as shown in FIG. 9A, immediately after the meniscus cut-off time there is a state in which the desired ink droplet 82 has separated and left a liquid column 81 that still projects from the nozzle 51, and if the common liquid chamber is pressurized in this state, then as shown in FIG. 9B, there is probability that a relatively small ink droplet 89 (a so-called "satellite ink droplet") is also propelled from the remaining liquid column 81 in addition to the desired ink droplet 82 that has been ejected previously. In general, it is difficult to apply a pulse waveform to the common liquid chamber driving piezoelectric element at a level that does not cause ink to be ejected from the nozzles, and consequently, this may cause detrimental effects to image quality.

Furthermore, there is a difficulty in adjusting the drive timings of the ink ejection and the ink refilling.

For example, in the inkjet head disclosed in Japanese Patent Application Publication No. 4-45947, it is necessary to apply a pulse waveform to the common liquid chamber driving piezoelectric element momentarily, immediately after the meniscus cut-off time, and in order to apply the pulse waveform to the common liquid chamber driving piezoelectric element at this strict timing, generally, it is necessary to adjust the timing at each ejection operation.

SUMMARY OF THE INVENTION

The present invention has been contrived in view of these circumstances, an object thereof being to provide an image forming apparatus whereby images can be stably formed at high speed, by promoting refilling of liquid into the pressure chambers, without causing detrimental effects to image formation due to the occurrence of satellite liquid droplets, or the like.

In order to attain the aforementioned object, the present invention is directed to an image forming apparatus, comprising: a plurality of ejection ports through which liquid is ejected toward a prescribed recording medium; a plurality of pressure chambers which are respectively connected to the plurality of ejection ports; a plurality of first actuators which respectively change volume of the plurality of pressure chambers; a common liquid chamber which is connected to the plurality of pressure chambers; a second actuator which changes volume of the common liquid chamber; and a drive unit which supplies drive signals to the first actuators and the second actuator, such that the first actuators cause the volume of the pressure chambers to contract to eject the liquid through the ejection ports and subsequently to expand the volume of the pressure chambers, and causes the second actuator to contract the volume of the common liquid chamber after the volume of the pressure chambers has been expanded.

According to the present invention, since the volume of the common liquid chamber is contracted after the volume of the pressure chambers has expanded again after ejecting the liquid from the ejection ports, then at the time that the volume of the pressure chamber is contracted, the liquid columns at the ejection ports are in a slightly withdrawn state inside the ejection ports, and refilling of the liquid to the pressure chambers is promoted without having detrimental effects on image formation, such as the occurrence of satellite liquid droplets. Therefore, it is possible to form a stable image at high speed.

Preferably, frequency of the drive signal applied to the second actuator by the drive unit is same as ejection frequency when the liquid is consecutively ejected through the ejection ports.

According to this aspect of the present invention, even in the case of forming a solid image over the whole surface, it is possible to form the image at high speed by reliably promoting the refilling of ink into the pressure chambers.

Preferably, the drive unit repeats action of expanding and contracting the volume of the common liquid chamber by means of the second actuator at a constant cycle, during image formation onto the recording medium.

According to this aspect of the present invention, since the expansion and contraction of the volume of the common liquid chamber is performed repeatedly at the constant cycle during the formation of an image onto the recording medium, then the start of the change of the volume of the common liquid chamber need only be controlled once, at the start of the image formation, thereby reducing the control load required to promote refilling. Furthermore, since the expansion and contraction of the common liquid chamber is repeated at the constant cycle during the formation of an image onto the recording medium, the liquid inside the common liquid chamber is churned continuously during the image formation and therefore an effect in preventing increase in the viscosity of the liquid can be expected.

Preferably, a direction of change of the volume of the common liquid chamber by means of the second actuator is substantially parallel to a direction of supply of the liquid to the pressure chambers from the common liquid chamber.

According to this aspect of the present invention, since the direction of change of the volume in the common liquid chamber due to the second actuator is substantially parallel with the direction of supply of the liquid from the common liquid chamber to the pressure chambers, then this means that the liquid is supplied efficiently from the common liquid chamber to the pressure chambers, by the change in the volume of the common liquid chamber caused by the second actuator, and hence refilling efficiency is further enhanced.

Preferably, the common liquid chamber is disposed above the pressure chambers when the pressure chambers are observed with the ejection ports downward.

According to this aspect of the present invention, it is possible to arrange the ejection ports at higher density, in comparison with a case where the common liquid chamber is arranged to the side of the pressure chambers when the pressure chambers are observed with the ejection ports downward, and furthermore, it becomes possible to shorten the flow path between the pressure chambers and the ejection ports in comparison with a case where the common liquid chamber is arranged between the pressure chambers and the ejection surface. Therefore, stability is improved in high-frequency ejection and the ejection of high-viscosity liquids.

According to the present invention, refilling of liquid into the pressure chambers is promoted without having detrimental effects on image formation due to the occurrence of satellite liquid droplets, or the like, and therefore it is possible to form a stable image at high speed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
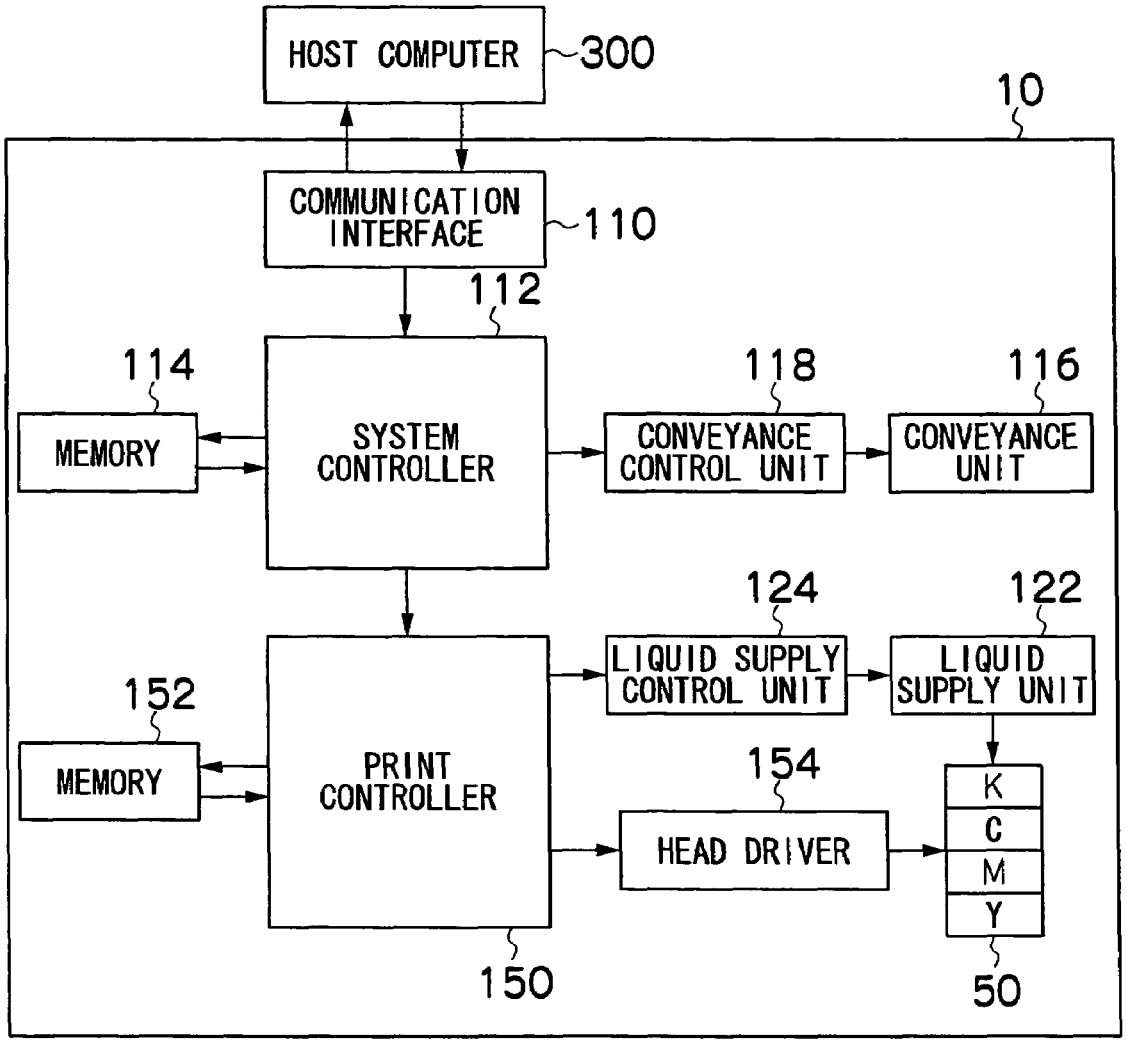
FIG. 1 is a block diagram showing the general composition of an image forming apparatus according to an embodiment of the present invention.

FIG. 1 is a block diagram showing the general composition of an image forming apparatus 10 according to an embodiment of the present invention.

In FIG. 1, the image forming apparatus 10 comprises: ink ejection heads 50, a communication interface 110, a system controller 112, a first memory 114, a second memory 152, a conveyance unit 116, a conveyance control unit 118, a liquid supply unit 122, a liquid supply control unit 124, a print controller 150, and a head driver (drive unit) 154.

The ink ejection heads 50 eject ink toward the recording medium, such as paper.

In the present embodiment, the image forming apparatus 10 is provided with the ink ejection heads 50 respectively for ink colors of K (black), C (cyan), M (magenta), and Y (yellow).

As described in detail later, each ink ejection head 50 has a plurality of nozzles for ejecting the ink, flow channels for supplying the ink to the plurality of nozzles, and the like.

The communication interface 110 is an image data input device for receiving image data transmitted from a host computer 300. For the communication interface 110, a wired interface such as a USB, IEEE 1394, Ethernet, or the like, or wireless interface can be used.

Image data sent from the host computer 300 is read into the image forming apparatus 10 through the communication interface 110, and is stored temporarily in the first memory 114.

The system controller 112 is constituted by a central processing unit (CPU) and peripheral circuits thereof, and the like, and it forms a main control device which controls the whole of the image forming apparatus 10 in accordance with a prescribed program. More specifically, the system controller 112 controls the respective units of the communication interface 110, the conveyance control unit 118, the print control unit 150, and the like.

The conveyance unit 116 is constituted by a conveyance system motor, and the like. The conveyance system motor applies a motive force to the rollers, belt, or the like, for conveying the recording medium, for example.

The conveyance control unit 118 is constituted by a motor driver, or the like. The motor driver is a driver (drive circuit) which drives the motor of the conveyance unit 116 in accordance with instructions from the system controller 112.

The liquid supply unit 122 is constituted by an ink tank forming an ink storage device for storing ink, and a channel and pump, or the like, which causes the ink to flow from the ink tank to each ink ejection head 50.

The liquid supply control unit 124 controls the supply of ink to each ink ejection head 50 by using the liquid supply unit 122, in accordance with instructions from the system controller 112.

The print controller 150 functions as an image processing device, which generates dot data for the respective ink colors on the basis of the image data inputted to the image forming apparatus 10. More specifically, the print controller 150 is a control unit which generates dot data for controlling ink ejection, from the image data stored in the first memory 114, by performing various image treatment processes, corrections, and the like, in accordance with the control implemented by the system controller 112, and the print controller 150 supplies the data (dot data) thus generated to the head driver 154.

The print controller 150 is provided with the second memory 152 as an image buffer memory, and image data, parameters, and other data are temporarily stored in the second memory 152 when the image is processed in the print controller 150. In FIG. 1, the second memory 152 is depicted as being attached to the print controller 150; however, it may also be combined with the first memory 114. Also possible is a mode in which the print controller 150 and the system controller 112 are integrated to form a single processor.

To give a general description of the sequence of processing from the input of image data to image formation, the image data inputted externally by means of the communication interface 110 is accumulated in the first memory 114. An image which appears to have a continuous tonal graduation to the human eye is formed on the recording medium by changing the droplet ejection density and the dot size of fine dots created by ink (coloring material), and therefore, it is necessary to convert the input image data into dot data that reproduces the tonal graduations of the image (namely, the light and shade toning of the image) as faithfully as possible. Therefore, image data stored in the image memory 114 is sent to the print controller 150 through the system controller 112, and is converted into dot data for each ink color by a digital half-toning technique, using dithering, error diffusion, or the like, in the print controller 150.

In other words, the print controller 150 performs processing for converting the input original image data into dot data for the four colors of K, C, M and Y. The dot data thus generated by the print controller 150 is stored in the second memory 152.

The head driver 154 outputs a drive signal for driving the ink ejection heads 50 on the basis of the dot data supplied by the print controller 150 (in other words, the dot data stored in the second memory 152).

By supplying the drive signal outputted from the head driver 154 to the ink ejection heads 50, ink is ejected from the ink ejection heads 50 onto the recording medium. By controlling ink ejection from the ink ejection heads 50 in synchronization with the conveyance speed of the recording paper, a prescribed image is formed on the recording paper.

Figure 2:
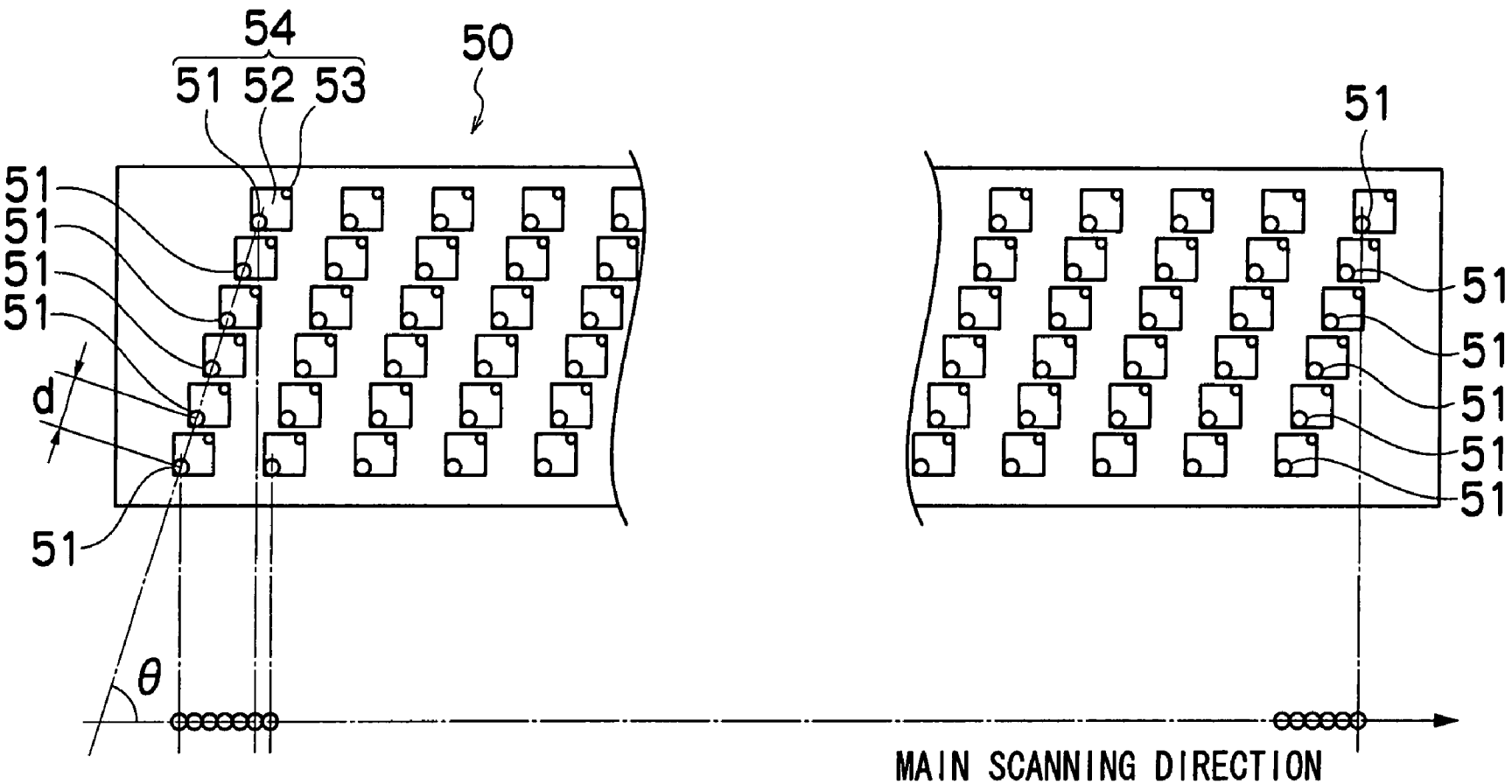
FIG. 2 is a plan view perspective diagram showing a general view of an embodiment of an ink ejection head.

FIG. 2 is a plan view perspective diagram showing a general view of an embodiment of the inkjet head 50.

In FIG. 2, the ink ejection head 50 comprises a plurality of pressure chamber units 54 arranged in a two-dimensional configuration, each pressure chamber unit 54 having a nozzle (ejection port) 51, which ejects ink, a pressure chamber 52 connected to the nozzle 51, which applies pressure to the ink when the ink is ejected from the nozzle 51, and an ink supply port 53 forming an opening section through which the ink is supplied to the pressure chamber 52.

In FIG. 2, in order to simplify the drawing, a portion of the pressure chamber units 54 is omitted from the drawing.

The plurality of nozzles 51 are arranged in a lattice configuration, following two directions: a main scanning direction (the direction substantially perpendicular to the conveyance direction of the recording medium); and an oblique direction forming a prescribed angle of θ with respect to the main scanning direction. More specifically, by arranging the plurality of nozzles 51 at a uniform pitch of d in an oblique direction forming a uniform angle of θ with respect to the main scanning direction, it is possible to treat the nozzles 51 as being equivalent to an arrangement of nozzles at a pitch P ($=d\times\cos\theta$) in a straight line in the main scanning direction. Consequently, it is possible to achieve a composition which is substantially equivalent to a high-density nozzle arrangement which reaches 2400 nozzles per inch in the main scanning direction, for example. By means of this composition, a high density is achieved in the effective nozzle pitch (projected nozzle pitch) as projected to an alignment in the lengthwise direction of the ink ejection head 50 (the main scanning direction). The nozzle arrangement shown in FIG. 2 is also called a two-dimensional matrix nozzle arrangement.

In other words, the plurality of nozzles 51 are arranged two-dimensionally in the ink ejection head 50, and the plurality of pressure chambers 52, related in a one-to-one correspondence with the nozzles 51, are also arranged two-dimensionally, in a similar fashion to the nozzles 51.

In implementing the present invention, the arrangement structure of the nozzles 51, and the like, is not limited in particular to the embodiment shown in FIG. 2. For example, it is also possible to compose an ink ejection head having nozzle rows of a length corresponding to the full width of the recording medium, by joining together in a staggered matrix arrangement, a number of short ink ejection head blocks, in which a plurality of nozzles 51 are arranged two-dimensionally. A nozzle arrangement of this kind also forms a nozzle arrangement having a two-dimensional matrix configuration.

The ink ejection head 50 having the nozzle arrangement in the two-dimensional matrix configuration as described above is a full line ink ejection head having a nozzle row extending through a length corresponding to the full width of the recording medium in the main scanning direction (the direction substantially perpendicular to the conveyance direction of the recording medium).

Figure 3:
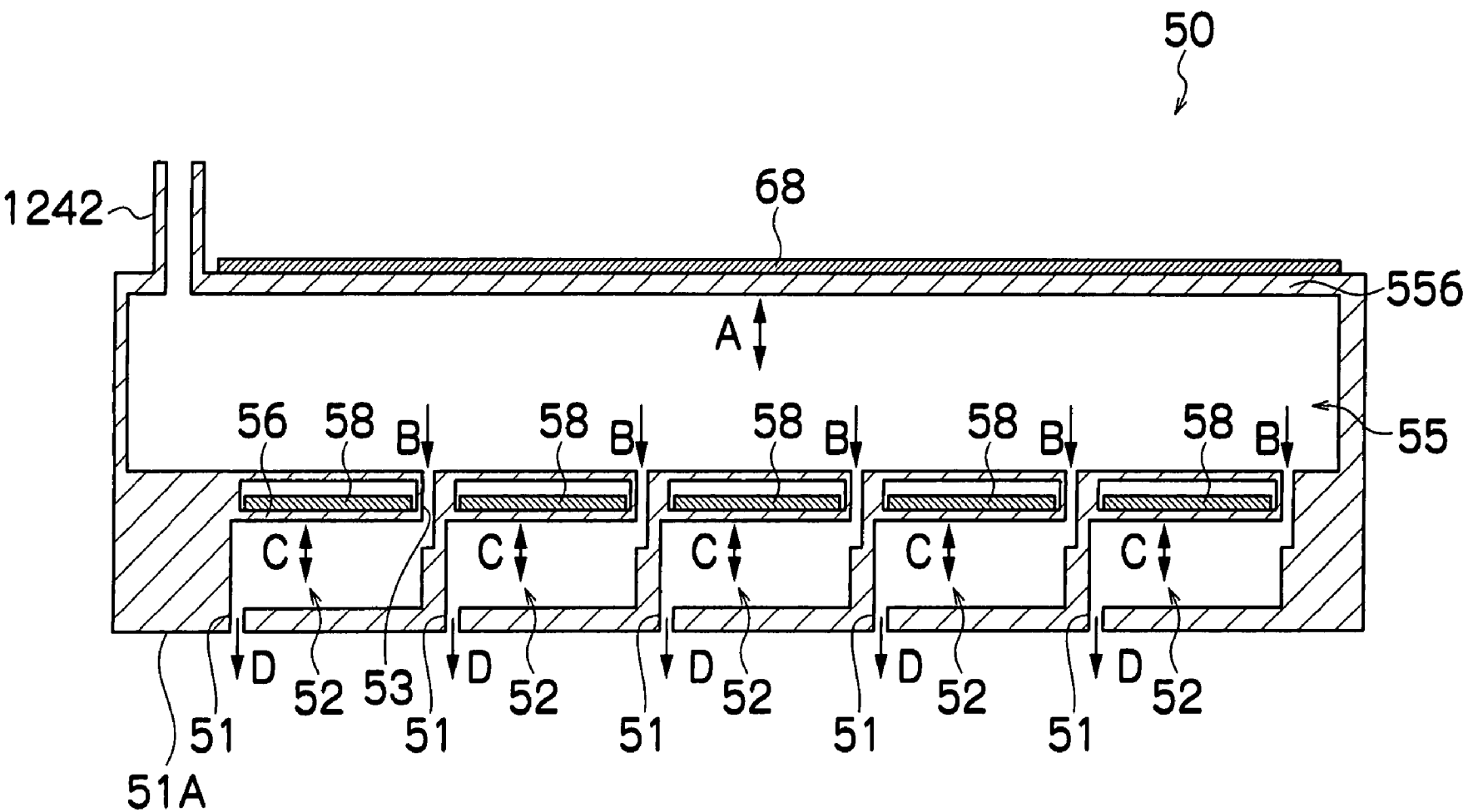
FIG. 3 is a cross-sectional diagram showing an embodiment of the internal structure of the ink ejection head.

FIG. 3 is a cross-sectional diagram showing an embodiment of the internal structure of the inkjet head 50.

In FIG. 3, the ink ejection head 50 comprises the plurality of nozzles 51 for ejecting ink, the plurality of pressure chambers 52 connected respectively to the plurality of nozzles 51, a plurality of piezoelectric elements (first actuators) 58 which respectively change the volume of the plurality of pressure chambers 52, a common liquid chamber 55 which is connected to the plurality of pressure chambers 52, and a piezoelectric element (second actuator) 68 which changes the volume of the common liquid chamber 55.

The nozzles 51, the pressure chambers 52, and the ink supply ports 53 of the pressure chambers 52 are the same as those shown in FIG. 2. FIG. 2 shows an arrangement of six nozzles 51 aligned in an oblique direction with respect to the main scanning direction, and FIG. 3 shows an arrangement of five nozzles aligned in the lateral direction in the diagram (corresponding to the oblique direction in FIG. 2). However, there is no particular restriction on the number of columns of nozzles 51. Furthermore, although all of the nozzles 51 and the ink supply ports 53 are aligned in one cross-sectional plane in FIG. 3, they are depicted in this way in order to simplify the description, and in practice, it is not a requirement for all of the nozzles 51 and the ink supply ports 53 to be aligned in one cross-sectional plane.

A diaphragm 56 is arranged on a side of the plurality of pressure chambers 52 reverse to the side where a nozzle surface 51A formed with the plurality of nozzles 51 is disposed, in such a manner that the plurality of pressure chambers 52 are arranged between the diaphragm 56 and the nozzle surface 51A. In other words, the diaphragm 56 is arranged over the pressure chambers 52 when the pressure chambers 52 are observed with the nozzles 51 downward.

Piezoelectric elements 58 forming actuators for the pressure chambers 52 which change the volume of the pressure chambers 52 are formed on the diaphragm 56.

The diaphragm 56 according to the present embodiment is formed by a single plate that is common for the plurality of pressure chambers 52, but it is not limited to a case of this kind, and may also be formed separately for each pressure chamber 52.

The piezoelectric elements 58 for the pressure chambers 52 are made of lead zirconate titanate, for example. When a prescribed electrical signal (drive signal) is applied to each piezoelectric element 58, the piezoelectric element 58 generates a displacement (distortion) and thereby changes the volume of the pressure chamber 52 through the diaphragm 56.

The common liquid chamber 55 receives ink from the ink tank (not illustrated) through a flow channel 1242, and supplies the ink to the plurality of pressure chambers 52, through the ink supply ports 53.

More specifically, the common liquid chamber 55 is formed as a flow channel constituting a single common space arranged over the plurality of pressure chambers 52 when the pressure chambers 52 are observed with the nozzles 51 downward, in such a manner that the common liquid chamber 55 covers all of the plurality of pressure chambers 52.

The common liquid chamber 55 may also be called a common flow channel for all of the nozzles 51. On the other hand, the pressure chambers 52 may be called individual flow channels for the respective nozzles 51.

The piezoelectric element 68 (the piezoelectric element 68 for the common liquid chamber 55), which changes the volume of the common liquid chamber 55, is arranged on a ceiling plate 556 of the common liquid chamber 55.

The common liquid chamber 55 is arranged on a side of the pressure chambers 52 and the piezoelectric elements 58 for the pressure chambers 52 reverse to the side where the nozzle surface 51A in which the plurality of nozzles 51 are formed is arranged, in such a manner that the pressure chambers 52 and the piezoelectric elements 58 for the pressure chambers 52 are arranged between the common liquid chamber 55 and the nozzle surface 51A. The piezoelectric element 68 for the common liquid chamber 55 is disposed on the side of the common liquid chamber 55 opposite to the side where the plurality of pressure chambers 52 and the piezoelectric elements 58 for the pressure chambers 52 are arranged, in such a manner that the common liquid chamber 55 is arranged between the piezoelectric element 68 for the common liquid chamber 55, and the plurality of pressure chambers 52 and the piezoelectric elements 58 for the pressure chambers 52.

In other words, when the pressure chambers 52 are observed with the nozzles 51 downward, then the common liquid chamber 55 is disposed over the pressure chambers 52 and the piezoelectric elements 58 for the pressure chambers 52, and the piezoelectric element 68 for the common liquid chamber 55 is disposed on the common liquid chamber 55.

The direction of the variation in the volume of the common liquid chamber 55 due to the piezoelectric element 68 for the common liquid chamber 55 (indicated by an arrow A in FIG. 3) is substantially parallel to the direction of supply of the ink from the common liquid chamber 55 to the pressure chambers 52 (indicated by arrows B in FIG. 3). Moreover, the direction of the variation in the volume of the pressure chambers 52 due to the piezoelectric elements 58 for the pressure chambers 52 (indicated by arrows C in FIG. 3) is substantially parallel to the direction of ejection of the ink from the nozzles 51 (indicated by arrows D in FIG. 3). Furthermore, the direction of change in the volume of the common liquid chamber 55 due to the piezoelectric element 68 for the common liquid chamber 55 (the arrow A) is substantially parallel to the direction of change of the volume of the pressure chambers 52 due to the piezoelectric elements 58 for the pressure chambers 52 (the arrows C). That is, the direction of change of the volume of the common liquid chamber 55 due to the piezoelectric element 68 for the common liquid chamber 55 (the arrow A), the direction of supply of the ink from the common liquid chamber 55 to the pressure chamber 52 (the arrows B), the direction of change of the volume of the pressure chambers 52 due to the piezoelectric elements 58 for the pressure chambers 52 (the arrows C), and the direction of ejection of the ink from the nozzles 51 (the arrows D) are all substantially parallel to each other.

The ink ejection head 50 shown in FIG. 3 has the common liquid chamber 55 disposed above the pressure chambers 52, but the present invention is not limited to cases of this kind.

Figure 4:
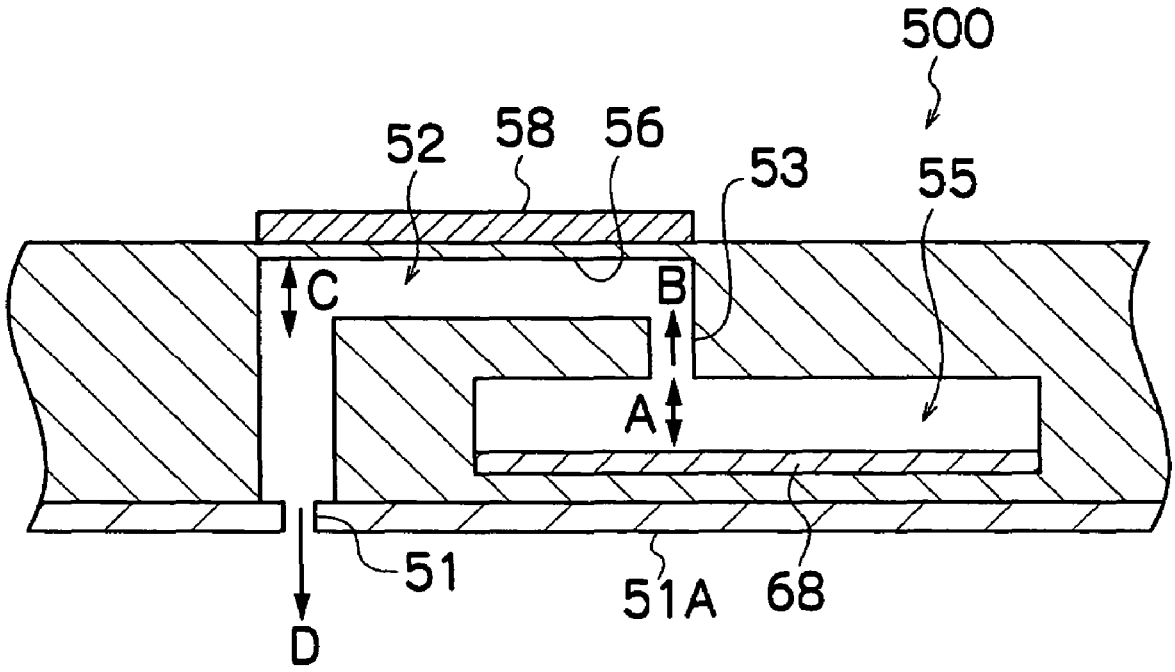
FIG. 4 is a cross-sectional diagram showing a further embodiment of the internal structure of the ink ejection head.

As shown in FIG. 4, it is also possible to use an ink ejection head 500 in which the common liquid chamber 55 is disposed below (or obliquely below) the pressure chambers 52 when the pressure chambers 52 are observed with the nozzles 51 downward.

Next, the image formation process in the image forming apparatus 10 according to the present embodiment is described.

Figure 5:
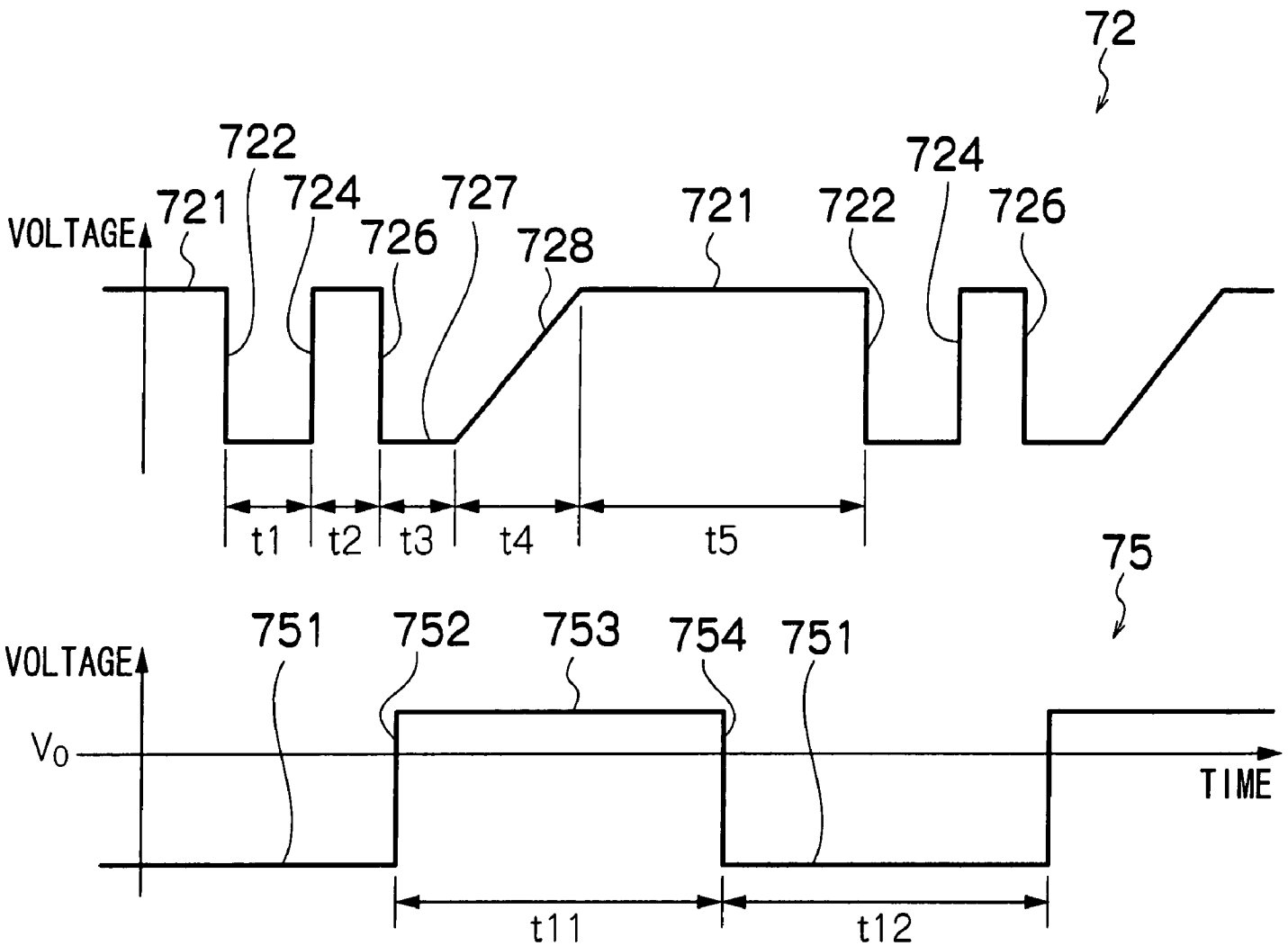
FIG. 5 is a waveform diagram showing an embodiment of a pressure chamber drive waveform for causing the volume of the pressure chamber to change, and a common liquid chamber drive waveform for causing the volume of the common liquid chamber to change.

FIG. 5 shows embodiments of a drive waveform 72 supplied to the piezoelectric elements 58 for the pressure chambers 52 (hereinafter, called the "pressure chamber drive waveform") and a drive waveform 75 supplied to the piezoelectric element 68 for the common liquid chamber 55 (hereinafter, called the "common liquid chamber drive waveform"). These drive waveforms 72 and 75 are of drive signals supplied from the head driver 154 in FIG. 1.

In FIG. 5, the vertical axis shows the voltage and the horizontal axis shows time. The voltage of the pressure chamber drive waveform 72 corresponds to the internal pressure of the pressure chamber 52, and the voltage of the common liquid chamber drive waveform 75 corresponds to the internal pressure of the common liquid chamber 55.

The pressure chamber drive waveform 72 is applied independently to each of the piezoelectric elements 58 of the pressure chambers 52, and the common liquid chamber drive waveform 75 is applied to the common piezoelectric element 68 of the common liquid chamber 55.

Although the pressure chamber drive waveform 72 is applied independently to each of the piezoelectric elements 58 for the pressure chambers 52 as described above, the waveform is taken in the following explanation to be a drive waveform for forming a solid image in order to simplify the description, in other words, it is assumed that the same pressure chamber drive waveform 72 is applied to all of the piezoelectric elements 58 for the pressure chambers 52.

Firstly, the control of the drive signal in the time period during which an ink ejection operation is performed (hereinafter, called the "ejection phase") is described.

In the present embodiment, ink is ejected from the nozzle 51 by causing the meniscus (liquid surface) in the nozzle 51 to change under the operation of a pull→push→pull sequence, on the basis of the pressure chamber drive waveform 72.

More specifically, as expressed in the pressure chamber drive waveform 72 in FIG. 5, in an initial state before starting the ink ejection operation, a prescribed initial voltage 721 is applied to the piezoelectric element 58 for the pressure chamber 52, and from this initial state, a voltage drop 722 for pulling the meniscus is applied, a voltage rise 724 for pushing the meniscus is applied, and then a voltage drop 726 for pulling the meniscus is applied.

In so doing, the volume of the pressure chamber 52 is made to change from the initial state, in the sequence: expand, contract, and expand. In other words, the internal pressure of the pressure chamber 52 changes from the initial state, in the sequence: decrease, increase, and decrease.

Figure 6A:
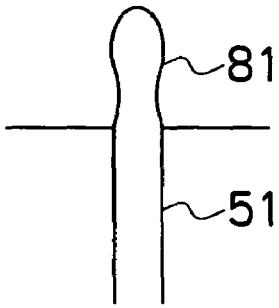
FIGS. 6A to 6C are illustrative diagrams for describing variation in the meniscus.
Figure 6B:
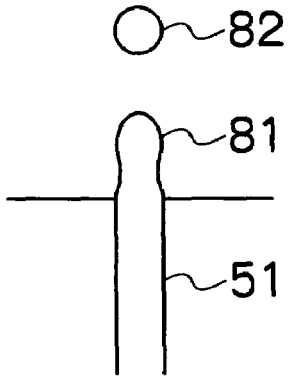
Figure 6C:
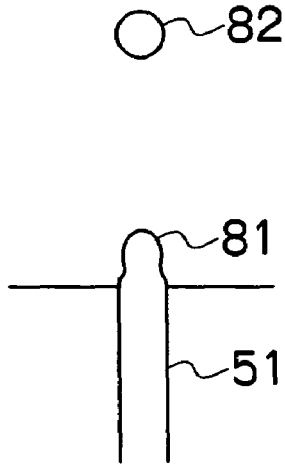

To describe the meniscus in the nozzle 51, the ink column 81 extends from the nozzle 51 as shown in FIG. 6A due to the push 724, which occurs at t1 after the first pull 722. At a prescribed time period t2 after the push 724, an ink droplet 82 separates from the ink column 81 as shown in FIG. 6B, and is ejected toward the recording medium. By means of the second pull 726, the remaining ink column 81 is pulled into the nozzle 51 as shown in FIG. 6C.

During the time period of the ink ejection phase (t1 and t2), a prescribed initial voltage 751 is applied to the piezoelectric element 68 for the common liquid chamber 55.

While the initial voltage 751 is thus applied to the piezoelectric element 68 for the common liquid chamber 55, the internal pressure of the common liquid chamber 55 is a negative pressure due to the pressure head differential between the common liquid chamber 55 and the sub-tank (not shown) connected to the common liquid chamber 55, and a negative pressure generating member provided in the sub-tank. Hereinafter, the negative pressure in the initial state created externally to the ink ejection head 50 is called the "initial negative pressure". In other words, the initial negative pressure is set as the internal pressure of the common liquid chamber 55 during the ink ejection phase (t1 and t2) when the initial voltage 751 is applied to the piezoelectric element 68 for the common liquid chamber 55.

Next, the control of the drive signal in the time period during which an ink refill operation is performed (hereinafter, called the "refill phase") is described.

In the present embodiment, the internal pressure of the common liquid chamber 55 is changed alternately between the initial negative pressure and a positive pressure. More specifically, during the ejection phase (t1 and t2) described above, the prescribed initial voltage 751 that sets the internal pressure of the common liquid chamber 55 to the initial negative pressure is applied to the piezoelectric element 68 for the common liquid chamber 55; and during the refill phase (t3 onward), a voltage rise 752 that switches the internal pressure of the common liquid chamber 55 from the initial negative pressure to the positive pressure is applied to the piezoelectric element 68 for the common liquid chamber 55, the voltage 753 after the voltage rise 752 is held for a prescribed time t11, and then a voltage drop 754 that returns the internal pressure of the common liquid chamber 55 from the positive pressure to the initial negative pressure is applied to the piezoelectric element 68 for the common liquid chamber 55.

Here, the timing of the switching of the internal pressure of the common liquid chamber 55 from the initial negative pressure to the positive pressure is described.

After ink has been ejected from the nozzle 51 by the push and pull actions of the meniscus, the piezoelectric element 58 for the pressure chamber 52 is held at the voltage 727 after the second pull action for the prescribed time period t3, as represented by the pressure chamber drive waveform 72 shown in FIG. 5. During the time period t3, the meniscus is maintained in a state where it is pulled slightly inside the nozzle 51 due to the surface tension of the ink. During the time period t3, the voltage rise 752 causing the volume of the common liquid chamber 55 to contract is applied to the piezoelectric element 68 of the common liquid chamber 55, thereby causing the internal pressure of the common liquid chamber 55 to change from the initial negative pressure to the positive pressure.

In other words, the volume of the pressure chamber 52 is contracted to eject the ink from the nozzle 51 and then expanded by the piezoelectric element 58 for the pressure chamber 52 in the ejection phase described above, and then the volume of the common liquid chamber 55 is contracted by the piezoelectric element 68 for the common liquid chamber 55 after the second expansion of the volume of the pressure chamber 52 during the refill phase.

Thus, the internal pressure of the common liquid chamber 55 is raised in a state where the meniscus is substantially withdrawn inside the nozzle 51, and therefore it is possible to promote the supply (refilling) of ink to the pressure chambers 52 from the common liquid chamber 55, while preventing satellite ink droplets from being ejected.

Next, the timing at which the internal pressure of the common liquid chamber 55 returns from the positive pressure to the initial negative pressure is described.

After the volume of the common liquid chamber 55 has been contracted by switching the internal pressure of the common liquid chamber 55 from the initial negative pressure to the positive pressure, as represented by the pressure chamber drive waveform 72 in FIG. 5, the voltage of the piezoelectric element 58 for the pressure chamber 52 is raised gradually from the voltage level 727 after the second pull action 726 to the voltage 721 of the initial state. More specifically, the volume of the pressure chamber 52 is returned gradually to the volume in the initial state, in such a manner that no ink is accidentally ejected from the nozzle 51.

The time period t4 during which the voltage of the piezoelectric element 58 of the pressure chamber 52 is raised gradually is set in such a manner that ink is not ejected accidentally from the nozzle 51. In other words, the gradient 728 at which the voltage of the piezoelectric element 58 of the pressure chamber 52 is raised gradually is set in such a manner that ink is not ejected accidentally from the nozzle 51.

On the other hand, the internal pressure of the common liquid chamber 55 is returned from the positive pressure to the initial negative pressure before the start of the next ink ejection operation.

More specifically, before the first pull of the next ejection phase (in other words, before the first voltage drop 722 of the piezoelectric element 58 for the pressure chamber 52), a voltage drop 754 for expanding the volume of the common liquid chamber 55 to the volume in the initial state is applied to the piezoelectric element 68 for the common liquid chamber 55.

FIG. 5 shows the embodiment of a case where the internal pressure of the common liquid chamber 55 is returned from the positive pressure to the initial negative pressure, after the volume of the pressure chamber 52 has returned to the initial state. More specifically, the internal pressure of the common liquid chamber 55 is returned from the positive pressure to the initial negative pressure within a time period of t5 after the voltage of the piezoelectric element 58 for the pressure chamber 52 has gradually risen and returned to the voltage 721 of the initial state.

The above-described refill operation is repeated at a constant cycle, during the formation of an image on the recording medium (during the image formation period). In other words, taking the cycle to be the time period formed by adding the positive pressure period t11 and the initial negative pressure period t12 shown in FIG. 5 (i.e., t11+t12), the common liquid chamber 55 is set alternately to the initial negative pressure and the positive pressure, from the first ejection to the final ejection during the image formation.

Accordingly, there is no need to control the start of driving each time ink is ejected, but rather, the start of the common liquid chamber drive signal needs to be controlled once only, at the start of image formation (and more specifically, before the first ejection).

The cycle of the common liquid chamber drive waveform 75 applied to the piezoelectric element 68 for the common liquid chamber 55 (i.e., the refill cycle $T_{fill}$=t11+t12) has the same length as the ejection cycle when ink is consecutively ejected from the same nozzle 51 (i.e., the maximum ejection cycle $T_{jet}$=t1+t2+t3+t4+t5).

The ejection cycle $T_{jet}$ (or the ejection frequency $1/T_{jet}$) differs between a case where a high-resolution image is formed and a case where a low-resolution image is formed. Therefore, the refill cycle $T_{fill}$ is also switched in accordance with the ejection cycle $T_{jet}$ (or the ejection frequency $1/T_{jet}$). More specifically, the print controller 150 shown in FIG. 1 specifies the ejection cycle $T_{jet}$ (or the ejection frequency $1/T_{jet}$) independently for each image, and switches the refill cycle $T_{fill}$ accordingly for each image.

Furthermore, if the ejection frequency coincides with the resonance frequency of the common liquid chamber 55, then there is a possibility that ink may be ejected from the nozzle 51 by the oscillation of the pressure due to the resonance effects. Therefore, the ejection frequency is made to be different from the resonance frequency of the common liquid chamber 55.

Next, a specific description of the positive pressure (hereinafter, called "$P_A$") and the initial negative pressure (hereinafter, called "$P_B$") of the common liquid chamber 55 is given.

The magnitudes (namely, the absolute values) of the positive pressure $P_A$ and the initial negative pressure $P_B$ in the common liquid chamber 55 must both be of levels at which the hemispherical meniscus is held by the surface tension of the ink in the nozzle 51.

Furthermore, the positive pressure $P_A$ (>0) and the initial negative pressure $P_B$ (<0) of the common liquid chamber 55 must satisfy the following formulas 1 and 2:

$$P_A+P_B<0, \text{ and} \tag{1}$$

$$P_A<2\gamma/r \text{ and } P_B>-2\gamma/r, \tag{2}$$

where r is the radius of the nozzle, and γ is the coefficient of surface tension of the liquid.

For example, if the nozzle radius is taken to be r=10 μm and the coefficient of surface tension the liquid is taken to be γ=30 mN/m, then $P_A$<6000 Pa and $P_B$>−6000 Pa, and $P_A+P_B$ is generally in the range of −300 Pa to −500 Pa.

Figure 7:
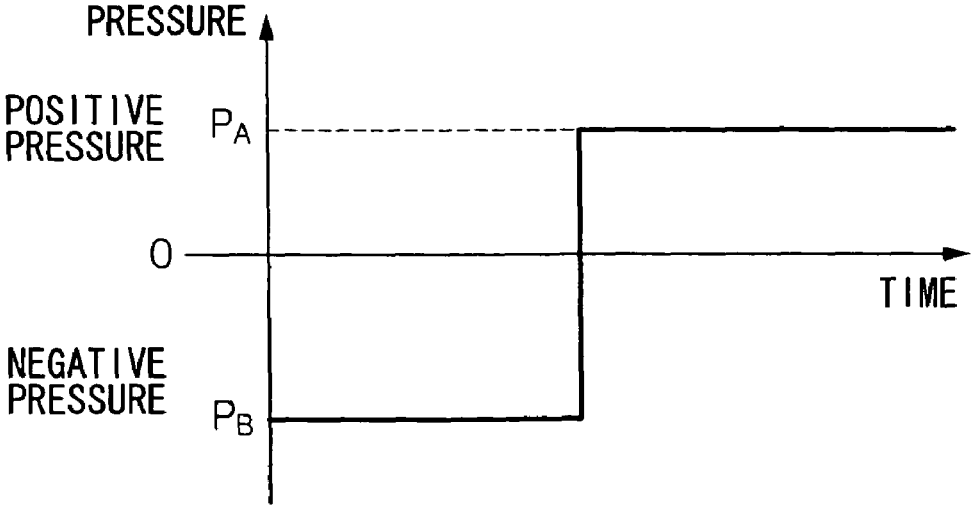
FIG. 7 is an illustrative diagram for describing positive pressure and negative pressure in the common liquid chamber.

Furthermore, in the present embodiment, the drive signal is applied to the piezoelectric element 68 for the common liquid chamber 55 in such a manner that the absolute value of the initial negative pressure $P_B$ becomes greater than the absolute value of the positive pressure $P_A$, as shown in FIG. 7.

Next, the relationship between the maximum ejection frequency, the conveyance speed of the recording medium, and the pitch between the nozzles 51 is described.

Figure 8:
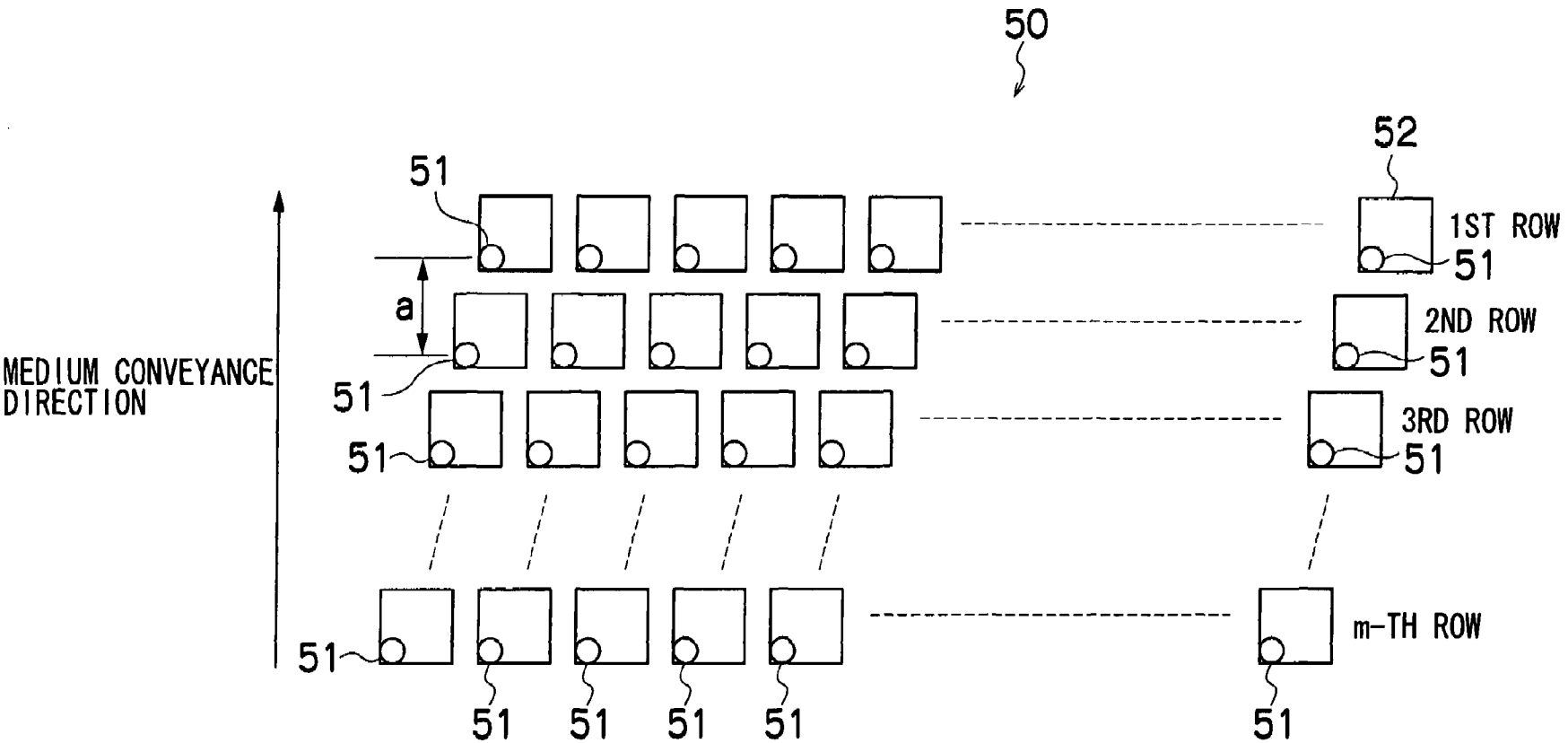
FIG. 8 is an illustrative diagram for describing the relationship between the nozzle pitch, the conveyance speed and the ejection frequency.
Figure 9A:
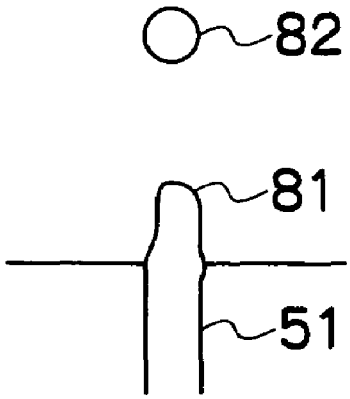
FIG.9A RELATED ART
FIGS. 9A and 9B are illustrative diagrams for describing the problem of satellite ink droplets in the related art.
Figure 9B:
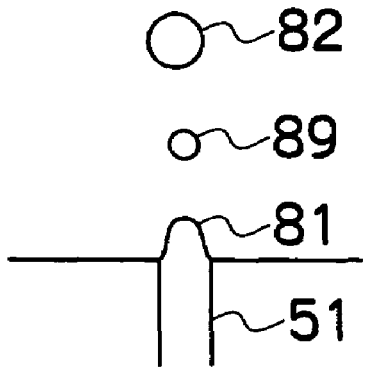
FIG.9B RELATED ART

As shown in FIG. 8, in the ink ejection head 50 in which the nozzle pitch in the medium conveyance direction (sub-scanning direction) is a, and where the liquid is supplied to a plurality of rows (for example, m rows) of the pressure chambers 52 from a single common liquid chamber 55, the nozzle pitch a is designed so as to satisfy the following formula 3:

$$a=n\times v/f, \tag{3}$$

where v is the conveyance speed of the recording medium, f is the maximum ejection frequency, and n is a natural number.

If a design is adopted which satisfies the above-described formula 3, then even when the volume of the common liquid chamber 55 is changed by the piezoelectric element 68 for the common liquid chamber 55, this has no detrimental effect on the ejection.

Hence, the length through which the paper is conveyed in the time period of n times of the ejection cycle is a. If ink refilling is performed using the piezoelectric element 68 for the common liquid chamber 55 as described above in the structure of the ink ejection head 50 according to the present embodiment, then it is necessary to set the internal pressure of the common liquid chamber 55 to the initial negative pressure when in the state of ejecting ink. Here, since the pressure switches from the initial negative pressure to the positive pressure at the ejection cycle, when the time period of n times of the ejection cycle has passed, the internal pressure becomes the same as the pressure in the initial state (i.e., the initial negative pressure). Consequently, by setting the pitch between the nozzles 51 so as to satisfy the above-described conditions, all of the nozzles 51 can be set to the initial negative pressure when ejecting and to the positive pressure when refilling.

Here, the mode has been described in which the internal pressure of the common liquid chamber 55 is changed alternately between the initial negative pressure and the positive pressure, but the present invention is not limited to this. It is also possible to make the internal pressure of the common liquid chamber 55 switch alternately between the initial negative pressure and another negative pressure that is weaker than the initial negative pressure (i.e., the negative pressure that has a higher pressure value than the initial negative pressure). In other words, the initial voltage 751 that sets the common liquid chamber 55 to the initial negative pressure, and a voltage that sets the common liquid chamber 55 to the negative pressure that is weaker than the initial negative pressure, are applied alternately to the piezoelectric element 68 for the common liquid chamber 55.

In the image forming apparatus 10 described above, the print controller 150 and the head driver 154 shown in FIG. 1 constitute the drive unit according to the present invention.

More specifically, the print controller 150 applies the drive waveforms (the drive signals) through the head driver 154 to the piezoelectric element 58 for the pressure chamber 52 and the piezoelectric element 68 for the common liquid chamber 55, so that the volume of the pressure chamber 52 is contracted to eject the ink from the nozzle 51 and then expanded by means of the piezoelectric element 58 for the pressure chamber 52, and after the volume of the pressure chamber 52 has been expanded, the volume of the common liquid chamber 55 is contracted by the piezoelectric element 68 for the common liquid chamber 55.

Furthermore, the print controller 150 applies the drive waveform (the drive signal) through the head driver 154 to the piezoelectric element 68 for the common liquid chamber 55, so that the expansion and contraction of the volume of the common liquid chamber 55 by means of the piezoelectric element 68 of the common liquid chamber 55 is repeated at a constant cycle during the formation of an image on the recording medium.

The embodiments of the present invention have been described in detail above, but the present invention is not limited to the embodiments described in the present specification, or the embodiments shown in the drawings, and it is of course possible for improvements or design modifications of various kinds to be implemented, within a range which does not deviate from the essence of the present invention.

For example, the embodiment has been described in which the volumes of the pressure chambers 52 and the common liquid chamber 55 are changed respectively by means of the piezoelectric elements 58 and 68, but the actuators of the present invention are not limited in particular to actuators constituted by piezoelectric elements, and magnetic actuators, which are driven by magnetism, may also be used, for example.

Furthermore, the case has been described in which the volume of the common liquid chamber 55 is changed by means of the actuator attached to the common liquid chamber 55, but it is also possible to adopt a composition in which the volume of the common liquid chamber 55 is changed by the liquid supply unit 122 in FIG. 1. For example, it is also possible to change the volume of the common liquid chamber 55 by means of a pump for supplying ink to the common liquid chamber 55. As stated previously, caution must be taken to use a device capable of changing the volume of the common liquid chamber 55 at the same frequency as the ejection frequency.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of operating an image forming apparatus, comprising:

supplying first drive signals to first actuators associated with pressure chambers each respectively connected to a respective ejection port to cause a volume of the pressure chamber to contract to eject liquid through the respective ejection port and subsequently expand the volume of the pressure chambers, and supplying second drive signals to a second actuator associated with a common liquid chamber connected to the pressure chambers to cause the second actuator to contract the volume of the common liquid chamber after the volume of the pressure chambers has been expanded.

2. The method of operating the image forming apparatus as defined in claim 1, wherein a frequency of the second drive signals supplied to the second actuator is the same as an ejection frequency when the liquid is consecutively ejected through the respective ejection port.

3. The method of operating the image forming apparatus as defined in claim 1, further comprising repeating action of expanding and contracting the volume of the common liquid chamber by means of the second actuator at a constant cycle, during image formation onto a recording medium.

* * * * *